US010022007B1

(12) United States Patent
Lucero

(10) Patent No.: US 10,022,007 B1
(45) Date of Patent: Jul. 17, 2018

(54) MAILBOX SHIELDING ASSEMBLY

(71) Applicant: Daniel Lucero, Shelby Township, MI (US)

(72) Inventor: Daniel Lucero, Shelby Township, MI (US)

( * ) Notice: Subject to any disclaimer, the term of this patent is extended or adjusted under 35 U.S.C. 154(b) by 0 days.

(21) Appl. No.: 15/609,673

(22) Filed: May 31, 2017

(51) Int. Cl.

| | |
|---|---|
| ***A47G 29/122*** | (2006.01) |
| ***G09F 7/18*** | (2006.01) |
| ***F21S 9/03*** | (2006.01) |
| ***F21S 8/00*** | (2006.01) |
| ***A47G 29/12*** | (2006.01) |
| *F21Y 115/10* | (2016.01) |

(52) U.S. Cl.
CPC ..... *A47G 29/122* (2013.01); *A47G 29/1216* (2013.01); *F21S 8/03* (2013.01); *F21S 9/037* (2013.01); *G09F 7/18* (2013.01); *F21Y 2115/10* (2016.08); *G09F 2007/1804* (2013.01); *G09F 2007/1873* (2013.01)

(58) Field of Classification Search
CPC ..... A47G 29/122; A47G 29/1216; F21S 8/03; F21S 9/037; G09F 7/18; G09F 2007/1804; G09F 2007/1873; F21Y 2115/10; E01F 9/627
USPC ..... 232/38, 39; 248/156, 560; 40/606.06; 362/154, 800; 404/10
See application file for complete search history.

(56) References Cited

U.S. PATENT DOCUMENTS

| | | | | |
|---|---|---|---|---|
| D262,409 | S | 12/1981 | Antonacci | |
| 5,029,783 | A * | 7/1991 | Alvarez | A47G 29/1216 232/39 |
| 5,460,326 | A * | 10/1995 | Albanesius | A47G 29/1216 232/17 |
| D365,190 | S * | 12/1995 | Albanesius | D99/43 |
| 6,109,519 | A * | 8/2000 | McClure | A47G 29/1216 232/17 |
| 6,223,982 | B1 | 5/2001 | Dunn | |
| D489,159 | S | 4/2004 | Hradisky | |
| 6,962,460 | B1 * | 11/2005 | Pratt | G09F 7/00 248/636 |
| 6,974,073 | B1 * | 12/2005 | Snyder | A47G 29/1203 232/1 C |
| 7,032,811 | B1 | 4/2006 | Paulic et al. | |
| 7,080,773 | B1 * | 7/2006 | Tepley | A47G 29/1216 232/17 |
| 7,364,066 | B1 | 4/2008 | Wilson | |
| 7,559,457 | B2 | 7/2009 | Webber | |
| 7,611,043 | B2 | 11/2009 | Black | |
| 8,794,505 | B1 | 8/2014 | Richardson | |
| 8,925,225 | B2 | 1/2015 | Fiore | |
| 9,549,632 | B2 * | 1/2017 | Pickens | A47G 29/122 |

(Continued)

*Primary Examiner* — William L Miller

(57) ABSTRACT

A mailbox shielding assembly for deflecting snow propelled by a plow away from a mailbox includes a base and a shell. The base is configured to couple to a surface, such as soil. The shell has a lower end, an upper end, a left side, a right side, a front and a back. The front is open to define a cavity. A plurality of connectors is coupled to and extends substantially perpendicularly between the base and the shell. A coupler is coupled to the shell and is positioned in the cavity. The coupler is configured to couple to a mailbox to position the mailbox within the cavity. The shell is configured to deflect matter, such as snow propelled by a plow, to shield the mailbox that is positioned in the cavity.

18 Claims, 4 Drawing Sheets

(56) References Cited

U.S. PATENT DOCUMENTS

| | | | | |
|---|---|---|---|---|
| 2006/0186188 | A1* | 8/2006 | Belanger | A47G 29/1209 232/38 |
| 2008/0149697 | A1* | 6/2008 | Webber | A47G 29/1216 232/39 |
| 2008/0314967 | A1* | 12/2008 | Black | A47G 29/1216 232/39 |
| 2016/0073812 | A1 | 3/2016 | Pickens | |
| 2017/0156533 | A1* | 6/2017 | Pajonas | A47G 29/1209 |

* cited by examiner

MAILBOX SHIELDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shielding assemblies and more particularly pertains to a new shielding assembly for deflecting snow propelled by a plow away from a mailbox.

BRIEF SUMMARY OF THE INVENTION

An embodiment of the disclosure meets the needs presented above by generally comprising a base and a shell. The base is configured to couple to a surface, such as soil. The shell has a lower end, an upper end, a left side, a right side, a front and a back. The front is open to define a cavity. A plurality of connectors is coupled to and extends substantially perpendicularly between the base and the shell. A coupler is coupled to the shell and is positioned in the cavity. The coupler is configured to couple to a mailbox to position the mailbox within the cavity. The shell is configured to deflect matter, such as snow propelled by a plow, to shield the mailbox that is positioned in the cavity.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
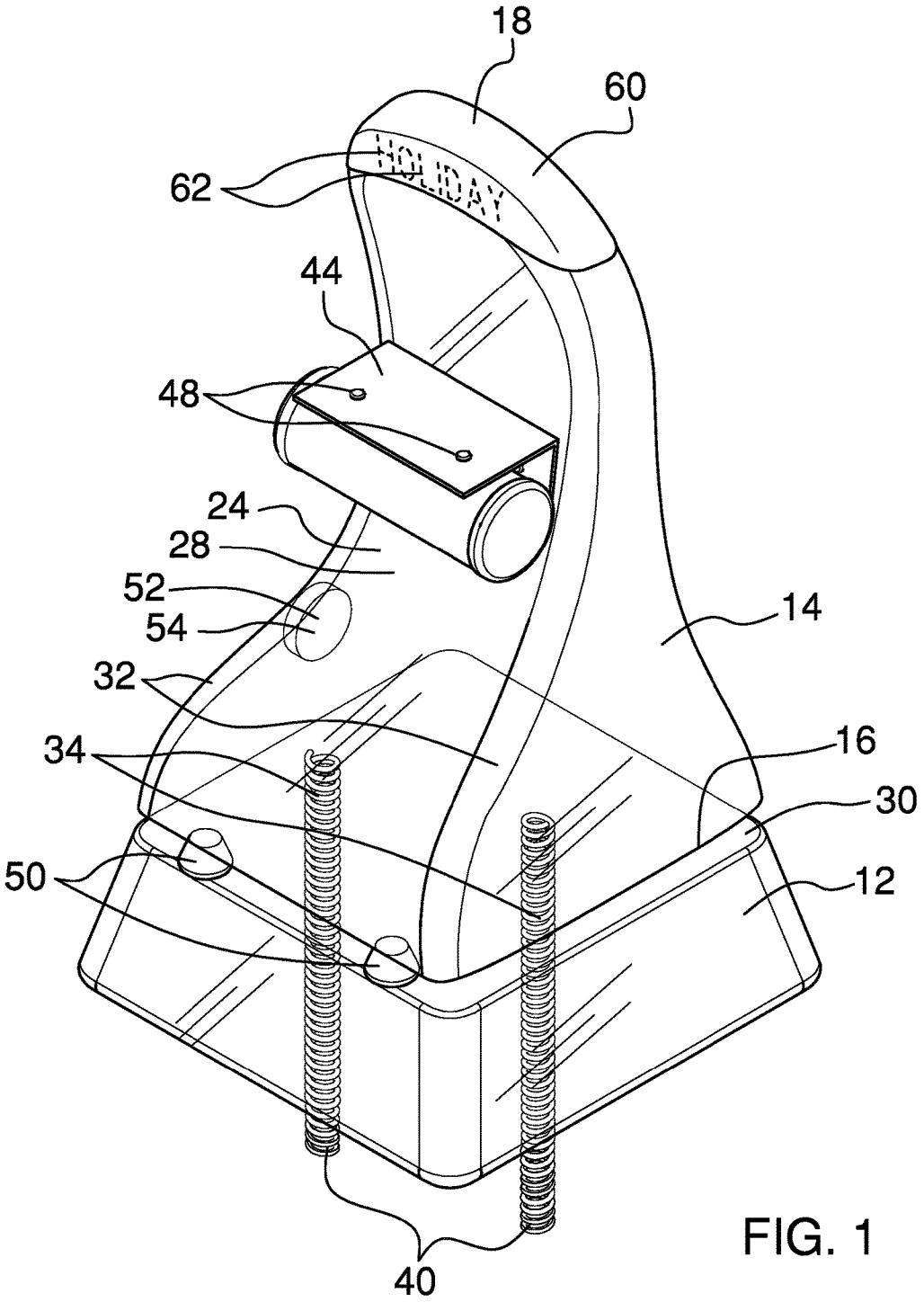
FIG. 1 is an isometric perspective view of a mailbox shielding assembly according to an embodiment of the disclosure.
Figure 2:
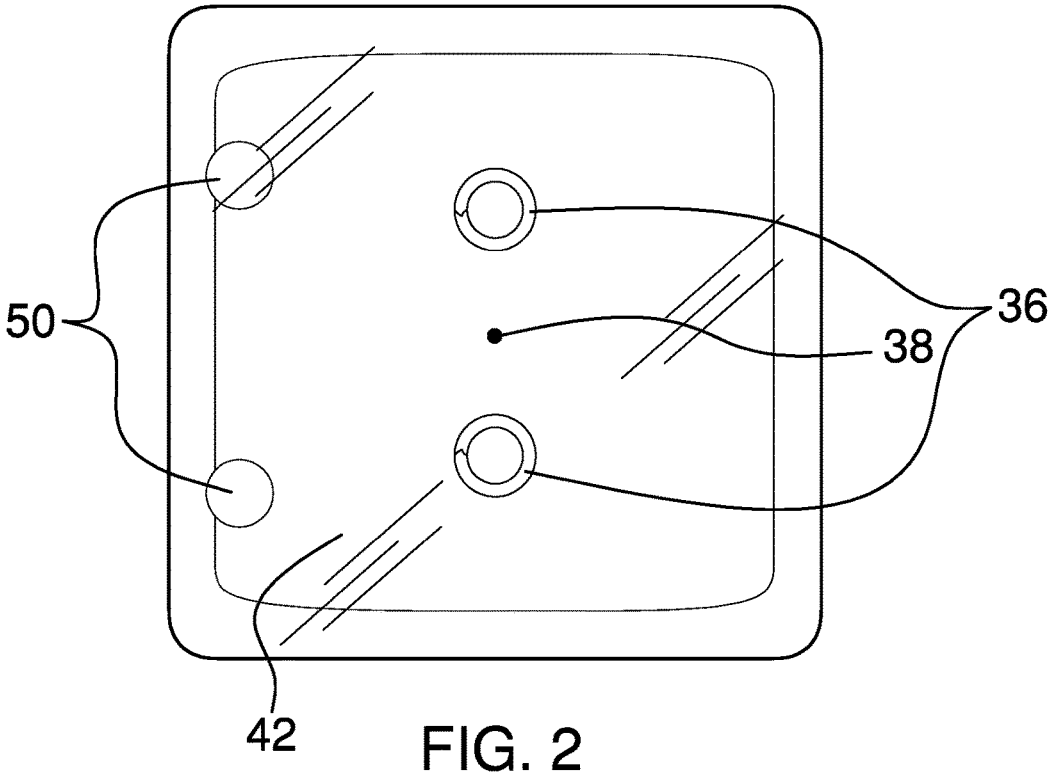
FIG. 2 is a bottom view of an embodiment of the disclosure.
Figure 3:
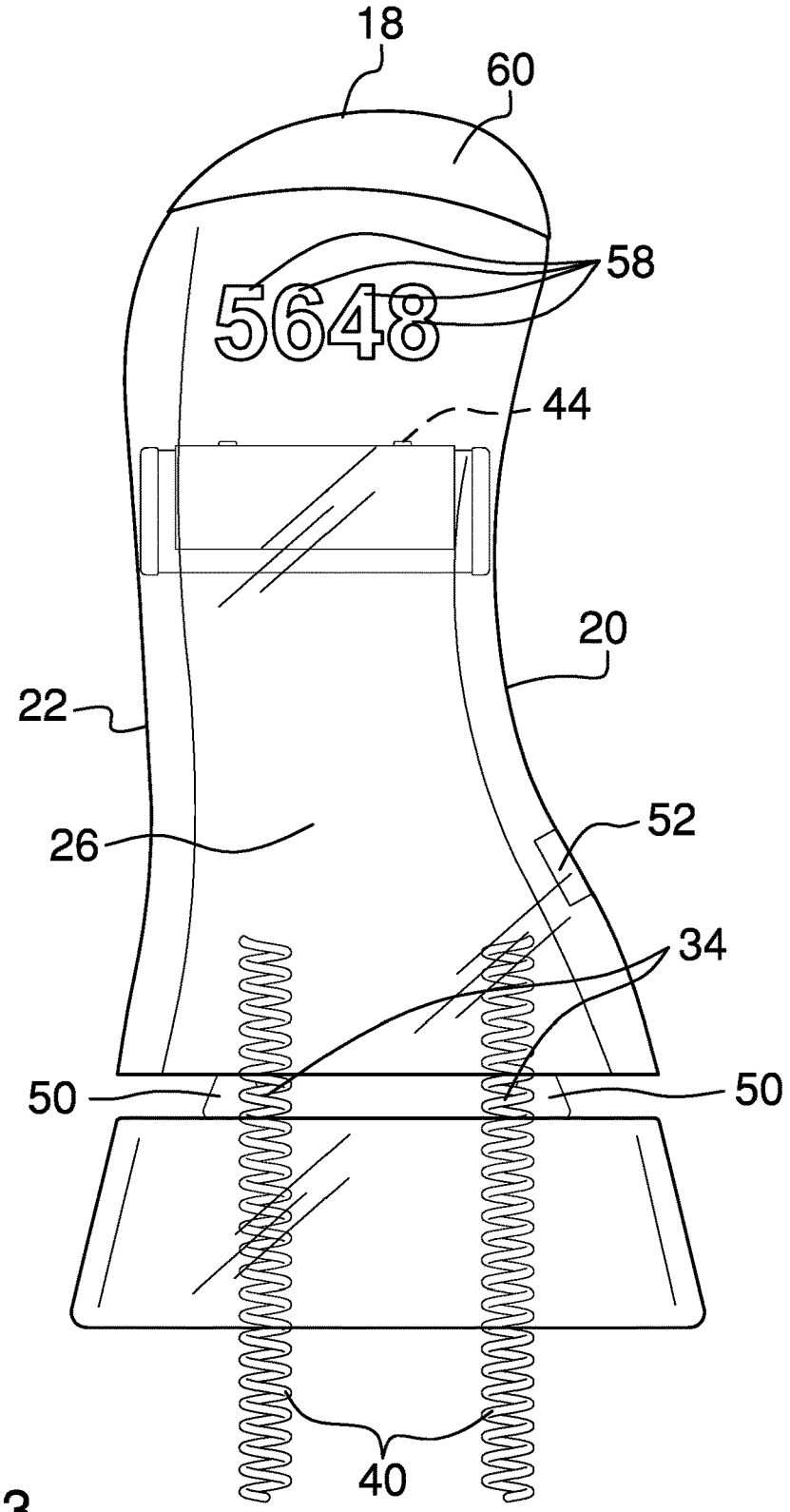
FIG. 3 is a back view of an embodiment of the disclosure.
Figure 4:
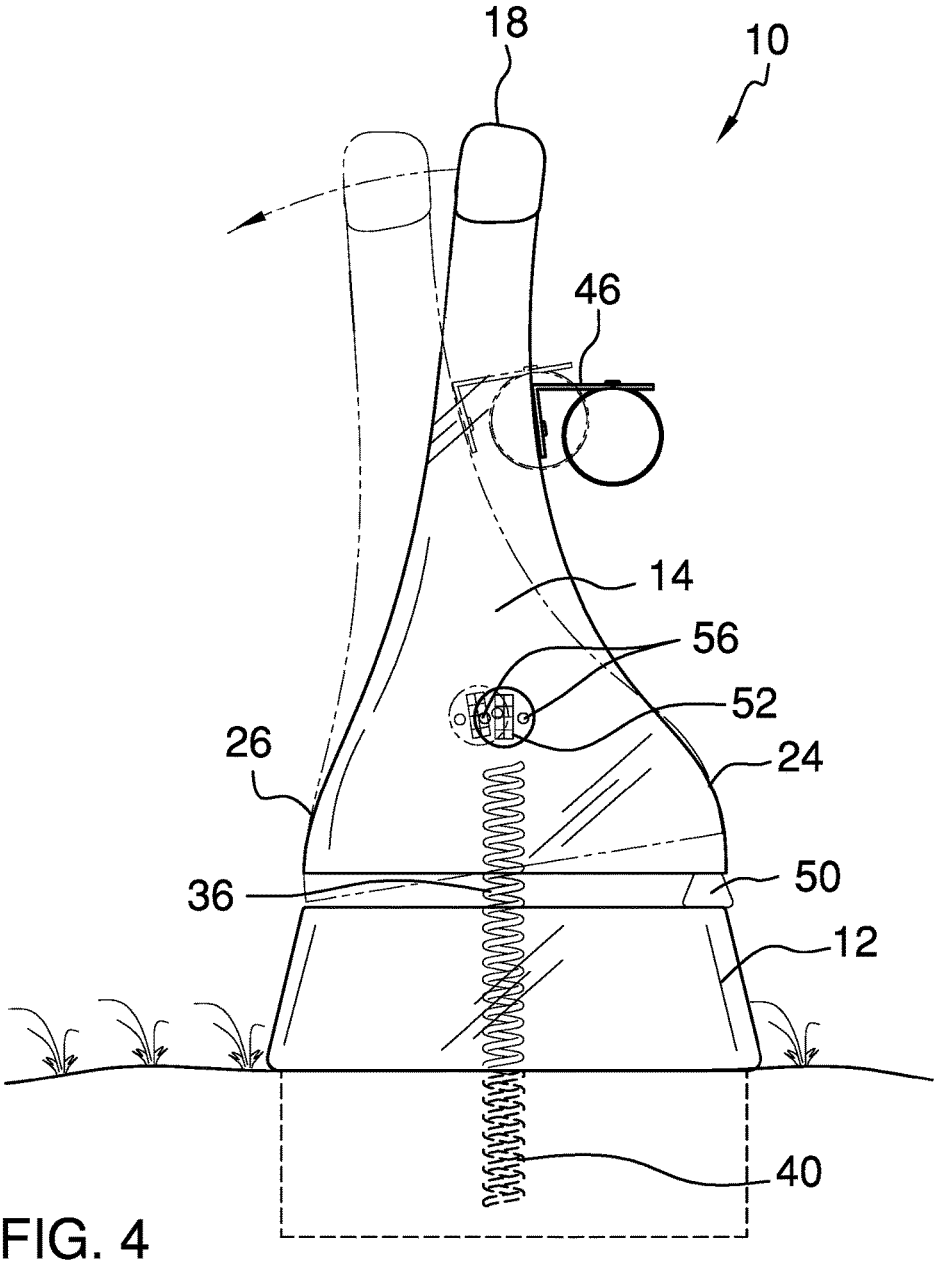
FIG. 4 is an in-use view of an embodiment of the disclosure.

With reference now to the drawings, and in particular to FIGS. 1 through 4 thereof, a new shielding assembly embodying the principles and concepts of an embodiment of the disclosure and generally designated by the reference numeral 10 will be described.

As best illustrated in FIGS. 1 through 4, the mailbox shielding assembly 10 generally comprises a base 12 and a shell 14. The shell 14 is configured to couple to a surface, such as soil. In one embodiment, the base 12 is truncated square pyramid shaped. In another embodiment, the base 12 comprises acrylate polymer so that the base 12 is substantially transparent.

The shell 14 has a lower end 16, an upper end 18, a left side 20, a right side 22, a front 24 and a back 26. The front 24 is open to define a cavity 28. In one embodiment, the lower end 16 is substantially complementary to a top 30 of the base 12. The left side 20 and the right side 22 each have a forward edge 32. In another embodiment, the forward edges 32 extend arcuately from the lower end 16 to the upper end 18 so that the front 24 is concavely shaped. In yet another embodiment, the left side 20 is concavely arcuate. In still yet another embodiment, the right side 22 is concavely arcuate proximate to the lower end 16 and concavely arcuate proximate to the upper end 18. In still yet another embodiment, the upper end 18 is convexly arcuate. In still yet another embodiment, the shell 14 comprises acrylate polymer so that the shell 14 is substantially transparent.

A plurality of connectors 34 is coupled to and extends substantially perpendicularly between the base 12 and the shell 14. In one embodiment, the connectors 34 are frangible. In another embodiment, each connector 34 comprises a spring 36. In yet another embodiment, the plurality of connectors 34 comprises two connectors 34 that bracket a midpoint 38 of the base 12.

A plurality of fasteners 40 is coupled to and extends from a bottom 42 of the base 12. The fasteners 40 are configured to be inserted into wet concrete so that the base 12 is coupled to the surface when the wet concrete dries. In one embodiment, each fastener 40 comprises an integral extension from a respective one of the springs 36. The respective spring 36 extends through the base 12 and protrudes perpendicularly from the bottom 42 of the base 12. The springs 36 are configured to be inserted into the wet concrete so that the base 12 is coupled to the surface when the wet concrete dries.

A coupler 44 is coupled to the shell 14 and is positioned in the cavity 28. The coupler 44 is configured to couple to a mailbox to position the mailbox within the cavity 28. In one embodiment, the coupler 44 comprises a bracket 46. The bracket 46 is L-shaped and extends substantially between the left side 20 and the right side 22 of the shell 14.

A plurality of penetrations 48 is positioned through the bracket 46. The penetrations 48 are configured to insert mounting hardware, such as bolts, to couple the bracket 46 to the mailbox. In one embodiment, the plurality of penetrations 48 comprises two penetrations 48.

A plurality of bumpers 50 is coupled to the base 12 and positioned between the base 12 and the shell 14. The bumpers 50 are positioned to cushion the shell 14 as the shell 14 is motivated angularly upon impact of matter, such as snow that is propelled by a plow. In one embodiment, the plurality of bumpers 50 comprises two bumpers 50 that are positioned proximate to the front 24 of the shell 14.

At least one solar cell 52 and a plurality of lights 54 are coupled to the shell 14. The lights 54 are operationally coupled to the at least one solar cell 52. The lights 54 are configured to illuminate the cavity 28. In one embodiment, the lights 54 comprise light emitting diodes 56. In another embodiment, the plurality of lights 54 is integral to the at least one solar cell 52.

In one embodiment, first indicia 58 are coupled to the shell 14. The first indicia 58 are configured to present information, such as an address and a logo, to persons that are proximate to the shell 14.

In another embodiment, the assembly 10 comprises a plurality of sleeves 60. Each sleeve 60 is complementary to the upper end 18 of the shell 14. The sleeve 60 is positioned to insert the upper end 18 to couple the sleeve 60 to the shell 14. Second indicia 62 are coupled to the sleeves 60. Respective second indicia 62 are positioned on an associated sleeve 60 so that each sleeve 60 is configured to present a message, such as a seasonal greeting, to the persons proximate to the shell 14.

In use the springs 36 are configured to be inserted into the wet concrete so that the base 12 is coupled to the surface when the wet concrete dries. The bracket 46 is positioned on the shell 14 so that the penetrations 48 are configured to insert the mounting hardware, such as the bolts, to couple the bracket 46 to the mailbox. The mailbox is positioned within the cavity 28. The shell 14 is configured to deflect the matter, such as the snow propelled by the plow, to shield the mailbox that is positioned in the cavity 28. The bumpers 50 are positioned on the base 12 to cushion the shell 14 as the shell 14 is motivated angularly upon the impact, such as by the snow propelled by the plow. The lights 54 that are positioned on the shell 14 are configured to illuminate the cavity 28. The first indicia 58 that are positioned on the shell 14 are configured to present the information, such as the address and the logo, to the persons proximate to the shell 14. Respective second indicia 62 are positioned on the associated sleeve 60 so that each sleeve 60 is configured to present the message, such as the seasonal greeting, to the persons proximate to the shell 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mailbox shielding assembly comprising:

a base configured for coupling to a surface;

a shell having a lower end, an upper end, a left side, a right side, a front and a back, said front being open defining a cavity;

a plurality of connectors coupled to and extending between said base and said shell, wherein said connectors extend in a direction which is substantially perpendicular to the surface;

a coupler coupled to said shell and positioned in said cavity, said coupler being configured for coupling to a mailbox; and wherein said coupler is positioned on said shell such that said coupler is configured for coupling to the mailbox such that the mailbox is positioned within said cavity, wherein said shell is positioned on said base such that said shell is configured for deflecting matter such that the mailbox positioned in said cavity is shielded.

2. The assembly of claim 1, further comprising:

said base being truncated square pyramid shaped; and said lower end of said shell being substantially complementary to a top of said base.

3. The assembly of claim 1, further including said base and said shell comprising acrylate polymer such that said base and said shell are substantially transparent.

4. The assembly of claim 1, further comprising:

said left side and said right side each having a forward edge, said forward edges extending arcuately from said lower end to said upper end such that said front is concavely shaped;

said left side being concavely arcuate;

said right side being concavely arcuate proximate to said lower end and concavely arcuate proximate to said upper end; and said upper end being convexly arcuate.

5. The assembly of claim 1, further including said connectors being frangible.

6. The assembly of claim 1, further including each said connector comprising a spring.

7. The assembly of claim 1, further including said plurality of connectors comprising two said connectors bracketing a midpoint of said base.

8. The assembly of claim 1, further including said coupler comprising a bracket, said bracket being L-shaped, said bracket extending substantially between said left side and said right side.

9. The assembly of claim 8, further including a plurality of penetrations positioned through said bracket, wherein said penetrations are positioned in said bracket such that said penetrations are configured for inserting mounting hardware for coupling said bracket to the mailbox.

10. The assembly of claim 9, further including said plurality of penetrations comprising two said penetrations.

11. The assembly of claim 9, further comprising:

at least one solar cell coupled to said shell;

a plurality of lights coupled to said shell, said lights being operationally coupled to said at least one solar cell; and wherein said lights are positioned on said shell such that said lights are configured for illuminating said cavity.

12. The assembly of claim 11, further including said lights comprising light emitting diodes.

13. The assembly of claim 11, further including said plurality of lights being integral to said at least one solar cell.

14. The assembly of claim 9, further comprising:

a plurality of sleeves, each said sleeve being complementary to said upper end of said shell such that said sleeve is positioned for inserting said upper end for coupling said sleeve to said shell;

second indicia coupled to said sleeves; and wherein respective said second indicia are positioned on an associated said sleeve such that each said sleeve is configured for presenting a message to persons proximate to said shell.

15. The assembly of claim 1, further including a plurality of bumpers coupled to said base and positioned between said base and said shell, wherein said bumpers are positioned on said base such that said bumpers are positioned for cushioning said shell as said shell is motivated angularly upon impact.

16. The assembly of claim 15, further including said plurality of bumpers comprising two said bumpers positioned proximate to said front of said shell.

17. The assembly of claim 1, further including first indicia coupled to said shell, wherein said first indicia are positioned on said shell such that said first indicia are configured for presenting information to persons proximate to said shell.

18. A mailbox shielding assembly comprising:

a base configured for coupling to a surface said base being truncated square pyramid shaped, said base comprising acrylate polymer such that said base is substantially transparent;

a shell having a lower end, an upper end, a left side, a right side, a front and a back, said front being open defining a cavity, said lower end being substantially complementary to a top of said base, said left side and said right side each having a forward edge, said forward edges extending arcuately from said lower end to said upper end such that said front is concavely shaped, said left side being concavely arcuate, said right side being concavely arcuate proximate to said lower end and concavely arcuate proximate to said upper end, said upper end being convexly arcuate, said shell comprising acrylate polymer such that said shell is substantially transparent;

a plurality of connectors coupled to and between said base and said shell, wherein said connectors extend in a direction which is substantially perpendicular to the surface, said connectors being frangible, each said connector comprising a spring, said plurality of connectors comprising two said connectors bracketing a midpoint of said base;

a coupler coupled to said shell and positioned in said cavity, said coupler being configured for coupling to a mailbox, wherein said coupler is positioned on said shell such that said coupler is configured for coupling to the mailbox such that the mailbox is positioned within said cavity, said coupler comprising a bracket, said bracket being L-shaped, said bracket extending substantially between said left side and said right side;

a plurality of penetrations positioned through said bracket, wherein said penetrations are positioned in said bracket such that said penetrations are configured for inserting mounting hardware for coupling said bracket to the mailbox, said plurality of penetrations comprising two said penetrations;

a plurality of bumpers coupled to said base and positioned between said base and said shell, wherein said bumpers are positioned on said base such that said bumpers are positioned for cushioning said shell as said shell is motivated angularly upon impact of matter said plurality of bumpers comprising two said bumpers positioned proximate to said front of said shell;

at least one solar cell coupled to said shell;

a plurality of lights coupled to said shell, said lights being operationally coupled to said at least one solar cell, wherein said lights are positioned on said shell such that said lights are configured for illuminating said cavity, said lights comprising light emitting diodes, said plurality of lights being integral to said at least one solar cell;

first indicia coupled to said shell, wherein said first indicia are positioned on said shell such that said first indicia are configured for presenting information to persons proximate to said shell;

a plurality of sleeves, each said sleeve being complementary to said upper end of said shell such that said sleeve is positioned for inserting said upper end for coupling said sleeve to said shell; and second indicia coupled to said sleeves, wherein respective said second indicia are positioned on an associate said sleeve such that each said sleeve is configured for presenting messages to persons proximate to said shell.

* * * * *